US005085737A

United States Patent [19]

Brogyanyi et al.

[11] Patent Number: 5,085,737

[45] Date of Patent: Feb. 4, 1992

[54] APPARATUS FOR THE DEWATERING OF A WEB OF CELLULOSIC MATTER OR A WEB OF MATERIAL FOR THE PASTEBOARD OR CARDBOARD PRODUCTION

[75] Inventors: Edgar Brogyanyi, Graz; Giselher Stummer, Kumberg; Franz P. Kittel; Roland Schick, both of Graz, all of Austria

[73] Assignee: Maschinenfabrik Andritz Actiengesellschaft, Graz, Austria

[21] Appl. No.: 536,102

[22] Filed: Jun. 8, 1990

[30] Foreign Application Priority Data

Jun. 9, 1989 [AT] Austria ..... 1424/89

[51] Int. Cl.[5] ..... D21F 3/04

[52] U.S. Cl. ..... 162/359; 162/301; 162/358; 162/360.1

[58] Field of Search ..... 162/358, 359, 360.1, 162/301; 100/93 RP, 121, 151, 153, 152, 118, 207, 208

[56] References Cited

U.S. PATENT DOCUMENTS

| | | | |
|---|---|---|---|
| 2,173,391 | 9/1939 | Ellis | 162/360.1 |
| 2,782,693 | 2/1957 | Williams | 162/360.1 |
| 3,215,592 | 11/1965 | Justus et al. | 162/358 |
| 3,477,907 | 11/1969 | Ely | 162/358 |
| 3,515,637 | 6/1970 | Reynolds et al. | 162/360.1 |
| 4,046,623 | 9/1977 | Schmid | 162/358 |
| 4,662,992 | 5/1987 | Berg . | |
| 4,704,192 | 11/1987 | Cronin . | |
| 4,879,001 | 11/1989 | Cronin | 162/359 |

FOREIGN PATENT DOCUMENTS

| | | |
|---|---|---|
| 0060878 | 5/1985 | European Pat. Off. . |
| 369802 | 2/1983 | Finland . |
| 2574829 | 6/1986 | France . |

*Primary Examiner*—Karen M. Hastings
*Assistant Examiner*—Brenda Lamb
*Attorney, Agent, or Firm*—Beveridge, DeGrandi & Weilacher

[57] ABSTRACT

The invention relates to apparatus for the dewatering of a web of cellulosic matter or a web of material for the pasteboard or cardboard production, having endless screen belts or the like circulating in opposite directions between which the web is made to pass for dewatering, the web being made to pass through at least one first dewatering zone with at least two screen belts or the like and thereupon to at least one further dewatering zone, in particular a compresion zone, with at least two screen belts. The invention is mainly characterized in that the web is made to pass at least largely unsupported from at least one dewatering zone serving as a pre-dewatering zone and in particular formed as a double screen belt press to at least one further dewatering zone, in particular to a compression zone in particular formed as a double screen belt press, preferably as a high-pressure press, one or a plurality of heating means, in particular means for applying a heating medium, conveniently one or a plurality of steam-blowing box(es), being provided behind the at least one first dewatering zone serving for pre-dewatering on the web or on the path of the web, in particular above it, one or a plurality of suction site(s), suction box(es) or/and heating means, in particular means for applying a heating medium, conveniently (a) suction box(es), being provided opposite to said steam-blowing box(es) on the other side, in particular underneath, the web or the path of the web, heating means and suction sites conveniently being disposed above and underneath the web opposite to one another and thus forming pairs.

49 Claims, 4 Drawing Sheets

APPARATUS FOR THE DEWATERING OF A WEB OF CELLULOSIC MATTER OR A WEB OF MATERIAL FOR THE PASTEBOARD OR CARDBOARD PRODUCTION

The invention relates to apparatus for the dewatering of a web of cellulosic matter or material for the production of pasteboard and cardboard having endless screen belts or the like circulating in opposite directions between which the web is made to pass for dewatering, the web being made to pass at least one first dewatering zone with at least two screen belts or the like and then to at least one further dewatering zone, in particular a compression zone, having at least two screen belts. Apparatus of a similar type, although for the dewatering of webs of material for paper production, belong to the state of the art. In view of the low thickness of the webs of material intended for paper production, supporting rolls or supporting belts are provided for them between the individual zones for wholly or largely supporting the thin material webs during the dewatering operation, such as it is done, e.g., according to U.S. Pats. No. 4,622,992, 4,704,192, FR-PS 2,574,829, European Patent No. 60,878 and AT-PS 369,802. These supporting devices in the form of screen belts or the like and of rolls largely cover the material webs at least from one side, so that the dewatering operation is impeded by the backed-up liquid or steam even if steam-blowing boxes and suction boxes are used. This is particularly the case if the material webs are made to pass between two screen belts along such steam-blowing or suction boxes or between pairs of such boxes.

It is the object of the invention to increase the dewatering performance in webs of cellulosic matter and webs of material for pasteboard and cardboard production, mainly of screen belt and double screen belt presses. The object includes not only an increase in production, but also a saving in energy. In machines for the dewatering of cellulosic matter and mechanical pulp and webs of material for the pasteboard and cardboard industry, this is of particular importance, because the webs of material required therefore are of considerable thickness.

These objects are achieved according to the invention mainly by providing for the web to be made to pass, at least largely unsupported, from at least one first dewatering zone in particular formed as a double screen belt press and serving for pre-dewatering to at least one further dewatering zone, in particular to a compression zone, in particular formed as a double screen belt press, preferably as a high-pressure press, one or a plurality of heating means, in particular means for applying a heating medium, conveniently (a) steam-blowing box(es), being arranged behind the at least one dewatering zone serving for pre-dewatering on the web or on the path of the web, in particular above it, one or a plurality of suction site(s) or suction box(es) or/and one or a plurality of heating means, in particular means for applying a heating medium, conveniently one or a plurality of steam box(es) being arranged on the opposite side, in particular underneath the web or the path of the web, heating means or suction sites conveniently being provided above and underneath the web opposing one another and thus forming pairs. Heating is effected in a known manner, in particular by blowing on a heating medium, conveniently steam, microwave heating or infrared irradiation. In this context, it is particularly convenient if the heating medium, in particular steam or air or liquid or water, is sucked off in the heating area, in particular the steam-blowing area, preferably on the underside of the web of material. The heating lines can conveniently consist of steam-blowing boxes or microwave heaters or infrared radiators located above or above and underneath the web of material. It is also possible to process mats or the like instead of webs of cellulosic material or pulp. By heating the material webs, in particular by applying steam to the web, in particular above a suction site, an increase in temperature, a decrease of the viscosity of the liquid, in particular of the water, a displacement heating and thus an improved dewatering performance and compression performance is achieved.

At pressing conditions equal to those of the state of the art, an increased dry matter content of the web is obtained according to the invention, because the web of material is made to pass at least largely unsupported from at least one dewatering zone to at least one further dewatering zone. In the uncovered areas of the web, the generated steam can escape without being backed up. The comparatively thick and thus stable material webs of cellulosic matter and webs of material for pasteboard and cardboard production permit comparatively long unsupported web portions.

It is most convenient for operation if the heating medium, in particular the steam, is applied, in particular blown on, at a temperature slightly in excess of 100° C., for instance about 105° C. This keeps the heating expenditure low and still largely assures the intended effect, in particular in view of the considerable unsupported web portions according to the invention.

Very favorable dewatering effects can be achieved if the heating means, in particular the steam-blowing box(es) or suction sit(es), in particular the suction box(es), are disposed in the area of the largely unsupported web on the web, namely, in particular between the double screen belts. The generated steam can then escape largely unhampered by adjacent machine or apparatus parts. Dewatering effects and evaporation can be particularly well metered and controlled if the gap between the heating means, in particular the steam-blowing box(es) and the suction site(s) or the suction box(es) or/and one a plurality of means for applying a heating medium, in particular steam-blowing box(es), is adjustable. To this end, the invention provides for the suction site(s) or the heating means, in particular the steam-blowing box(es), to be adjustable. Such a gap adjustment can conveniently be achieved by providing for the suction box(es) or steam-blowing box(es) to be pivotal about an axis.

BRIEF DESCRIPTION OF DRAWINGS

The invention is explained by means of exemplary embodiments with reference to the accompanying drawings, identical reference symbols being used for identical or similar parts of apparatus and machinery.

DETAILED DESCRIPTION

Figure 1:
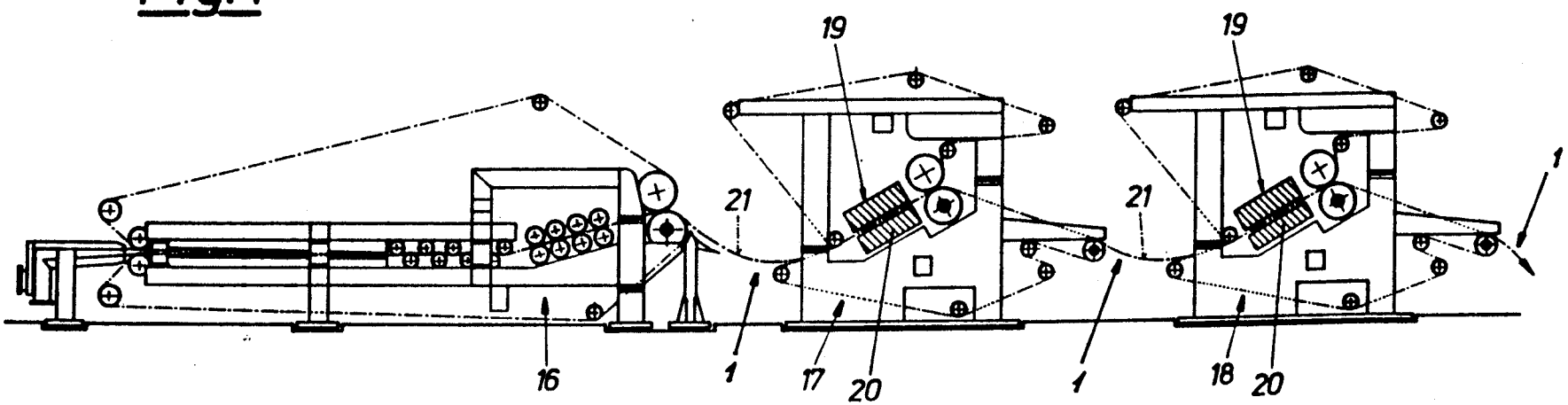
FIGS. 1 and 2 show systems having two high-pressure presses disposed behind a double screen belt press, with freely suspended or unsupported portions of webs of cellulosic matter or material for the pasteboard and cardboard production.
Figure 2:
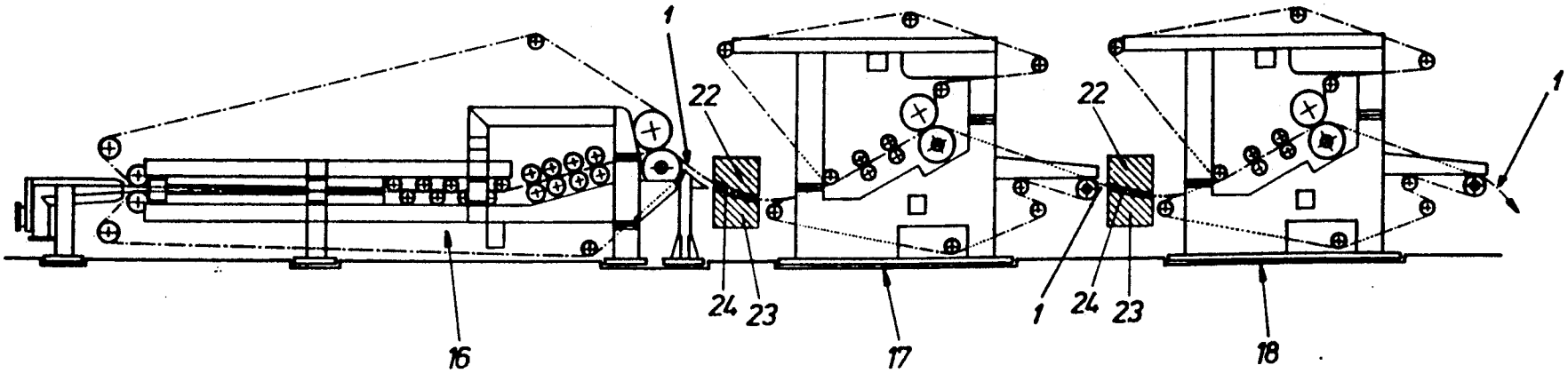

FIGS. 1 and 2 are diagrammatic representations of systems composed of one each double screen belt press 16 and two high-pressure presses 17 and 18. They differ above all by the different location of the heating and suction means or lines. According to FIG. 1, the heating means or heating line 19 is accommodated in the high-pressure press, just like the optionally associated suction zones 20. The pre-dewatered webs 1 of pulp or material are conveyed with parts 21 substantially unsupported, i.e. freely suspended, between the individual presses. In the system according to FIG. 2, a certain degree of guidance for the webs 1 of pulp or material results in the space between the individual presses because the heating means or heating lines 22 are disposed in these gaps and form corresponding guides 24 with the suction means or further heating means 23, although without supporting the web of material to a decisive extent.

Figure 3:
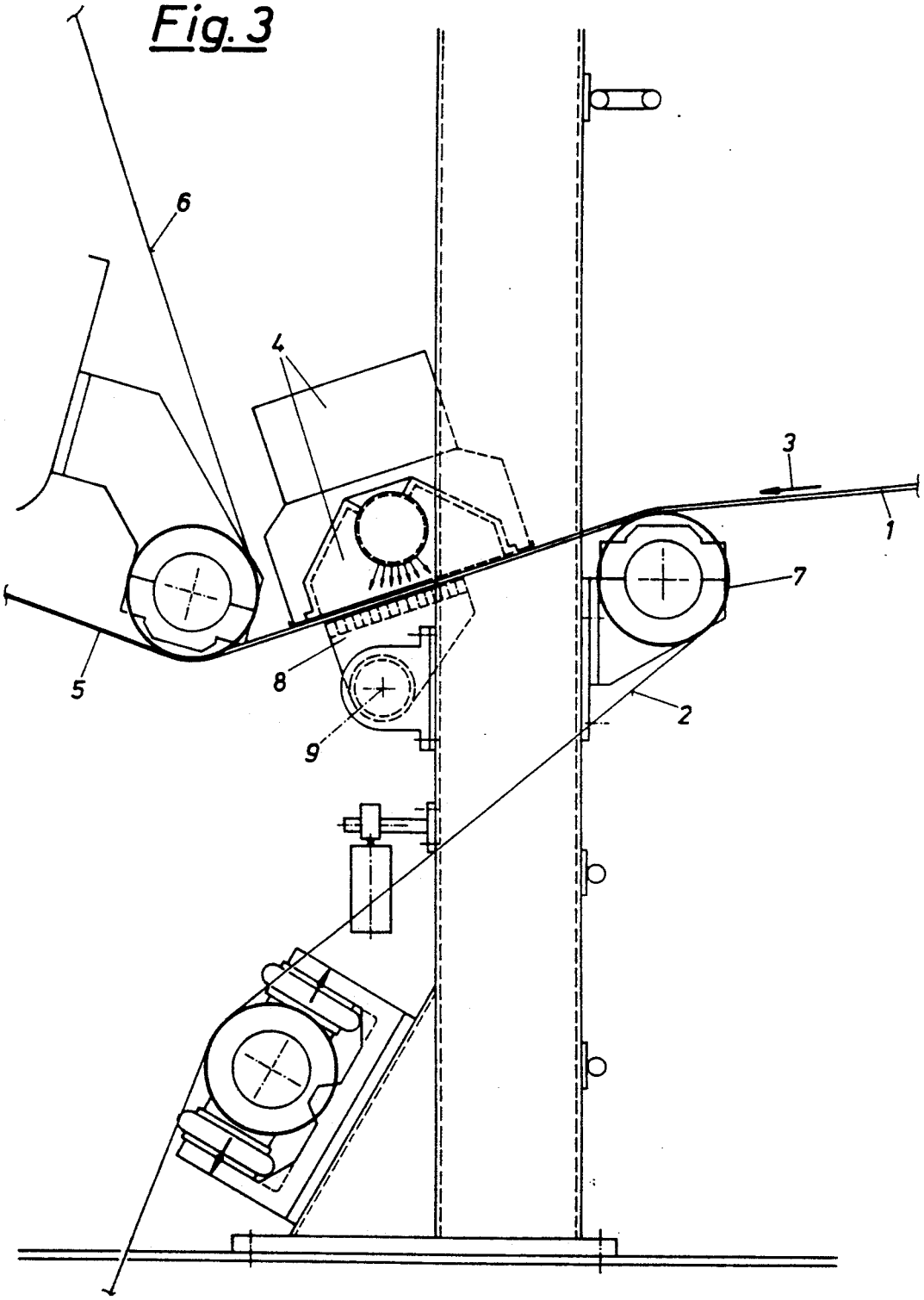
FIG. 3 shows the front side of a double screen belt press also suitable for use in this operation with upper screen or felt belt slightly offset backwards and FIG. 4 shows a double screen belt press with superimposed screen belts with inclined main compression zone, the heating lines and suction zones being disposed in the compression zone in these two cases similarly to FIG. 1.
Figure 4:
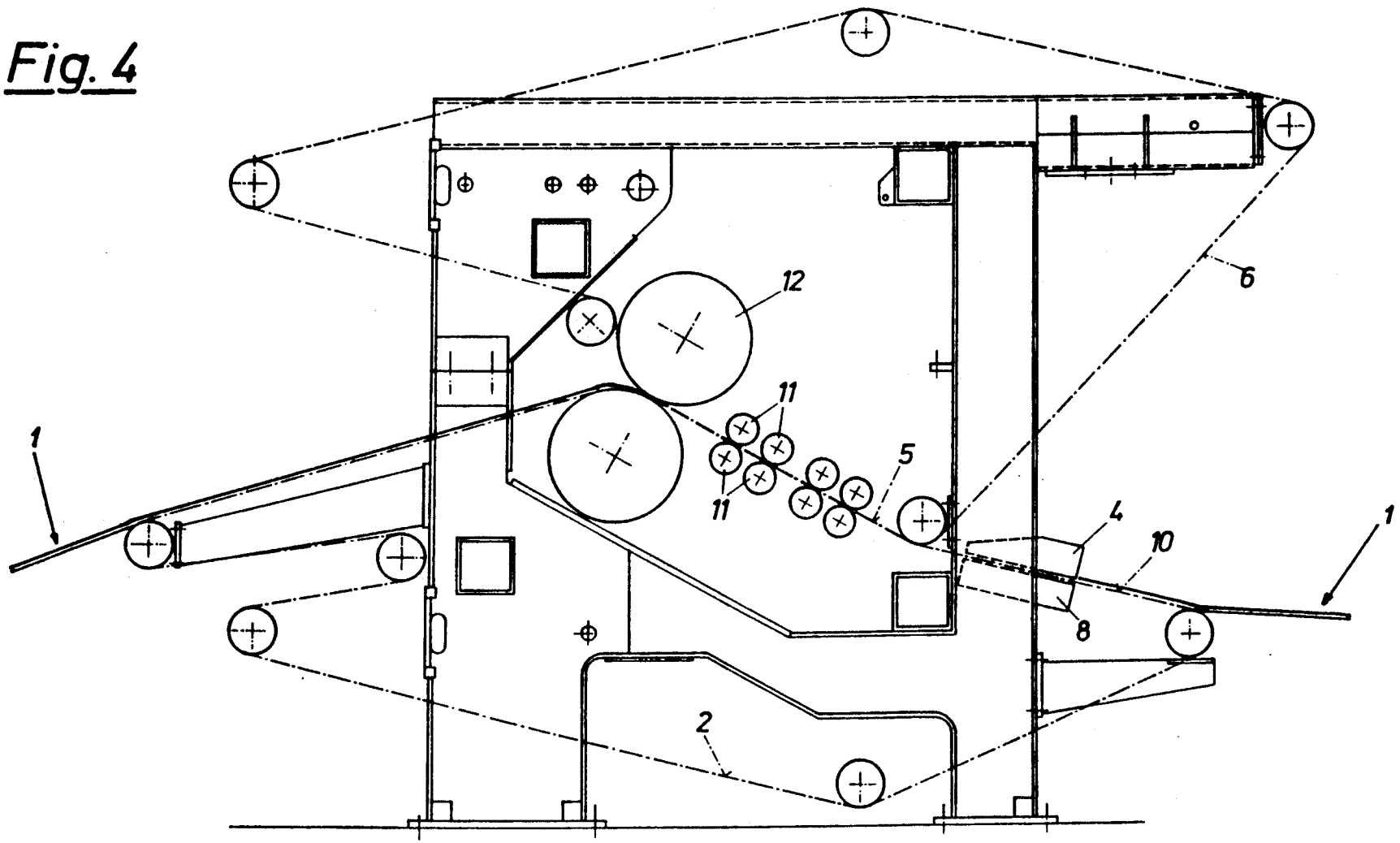

FIGS. 3 and 4 show screen presses suitable for use in carrying out the invention. According to FIG. 3, the web 1 of pulp or material is applied to the lower screen or felt belt 2 in the direction of the arrow, then passes the steam-blowing box 4 and from there to the wedge press nip 5 between the screen belts 2 and 6, the latter, the upper screen belt, being correspondingly offset backwards in the direction of the pulp belt advance 3 in relation to the front 7 of the lower screen belt 2. To enhance the dewatering effect, a suction means 8 pivotal about the axis 9 for screen belt or felt belt replacement and gap adjustment is provided opposite to the steam-blowing box 4.

The system according to FIG. 4 is of similar layout, although the two screen belts 2 and 6 are represented completely, albeit diagrammatically. The steam-blowing box 4 and the suction means 8 are provided in the ascending area of the lower screen belt 2 immediately in front of the press nip 5 formed between the two screen belts, the press nip 5 additionally being provided with compression rolls 11 and a press nip 12 on the inside of the closed belts 2,6. The guide and driving rolls of the screen belts are formed in a conventional manner.

The steam-blowing boxes and other heating means can always be provided on both sides of the material web or the screen belts or the upper length of the lower screen belt, i.e. there is always one heating means disposed above the respective length of belt and one underneath it. This can also apply to the suction means. Hot liquid, in particular hot water, can be used instead of steam. Also suitable is a microwave heater or infrared radiator. The invention is also suitable for other treatments of webs of pulp or material, for instance in the presence or when using various chemicals.

We claim:

1. An apparatus for the dewatering of a web of material for the production of pasteboard or cardboard, comprising:

endless screen belts and means for circulating said endless screen belts;

a first dewatering zone with at least two of said screen belts circulating in opposite directions so as to force the web material through and away from said first dewatering zone;

a second dewatering zone positioned downstream from said first dewatering zone with at least two of said screen belts circulating in opposite directions so as to force the web material through and away from said second dewatering zone;

said first and second dewatering zones being dimensioned and arranged so as to provide an open area between said first and second dewatering zones and to pass the web along and without a screen belt through the open area in an unsupported and freely suspended state, and said apparatus being structured and arranged such that the freely suspended web, while passing through the open area, curves downwardly;

heating means for heating the web, said heating means being positioned adjacent a first surface of the web and downstream from said first dewatering zone;

a dewatering device positioned on an opposite surface of the web and in opposing relationship with said heating means.

2. An apparatus according to claim 1 further comprising a second heating means and a second dewatering device positioned upstream, with respect to web passage, from said first dewatering zone.

3. An apparatus according to claim 1 wherein said heating means includes a heating element positioned within said second dewatering zone.

4. An apparatus according to claim 1 wherein said heating means includes a heating element positioned downstream from said first dewatering zone and upstream from said second dewatering zone.

5. The apparatus according to claim 1, wherein said first dewatering zone is formed as a double screen belt press.

6. The apparatus according to claim 1, wherein said second dewatering zone is formed as a compression zone.

7. The apparatus according to claim 6, wherein said compression zone is formed as a double screen belt press.

8. The apparatus according to claim 6, wherein said compression zone is formed as a high-pressure press.

9. The apparatus according to claim 1, wherein said heating means is a steam-blowing box.

10. The apparatus according to claim 1, wherein said heating means is arranged above said web.

11. The apparatus according to claim 1, wherein said dewatering device is a suction site.

12. The apparatus according to claim 11, wherein said suction site is a suction box.

13. The apparatus according to claim 11, wherein said suction site is provided underneath said web.

14. The apparatus according to claim 1, wherein said dewatering device is at least one further heating means.

15. The apparatus according to claim 14, wherein said further heating means for applying a heating medium is a steam-blowing box.

16. The apparatus according to claim 11, wherein said heating means and suction site are disposed opposite to one another so as to form a pair.

17. The apparatus according to claim 1, wherein said heating means is disposed in said open area.

18. The apparatus according to claim 11, wherein said suction site is disposed in said open area.

19. The apparatus according to claim 11, wherein said heating means and said suction site are disposed in said open area and said first and second dewatering zones are double screen belt presses.

20. The apparatus according to claim 1, wherein a gap between the heating means and said dewatering device is provided, said gap being adapted for passage or the web therethrough and said apparatus further comprising gap adjustment means.

21. The apparatus according to claim 20, wherein said dewatering device is a further heating means.

22. The apparatus according to claim 20, wherein said dewatering device includes suction means.

23. The apparatus according to claim 21, wherein said heating means and further heating means are adjustable.

24. The apparatus according to claim 22, wherein said adjustment means adjusts the position of said suction means.

25. The apparatus according to claim 24, wherein said suction means is pivotal about an axis.

26. The apparatus according to claim 23, wherein said heating means is pivotal about an axis.

27. An apparatus for dewatering of a web of cellulosic matter, comprising:

endless screen belts and means for circulating said endless screen belts;

a first dewatering zone with at least two of said screen belts circulating in opposite directions so as to force the web material through and away from said first dewatering zone;

a second dewatering zone with at least two of said screen belts circulating in opposite directions so as to force the web material through and away from said second dewatering zone;

said first and second dewatering zones being dimensioned and arranged so as to provide an open area between said first and second dewatering zones and to pass the web alone and without a screen belt through the open area in an unsupported and freely suspended state;

heating means for heating the web, said heating means being positioned downstream, with respect to web passage, at a distance from said first dewatering zone; and wherein said apparatus is structured and arranged such that said part of the web passing unsupported and freely suspended through said open area is curved downward.

28. The apparatus according to claim 27, wherein said first dewatering zone is formed as a double screen belt press.

29. The apparatus according to claim 27, wherein said second dewatering zone is formed as a compression zone.

30. The apparatus according to claim 29, wherein said compression zone is formed as a double screen belt press.

31. The apparatus according to claim 29, wherein said compression zone is formed as a high-pressure press.

32. The apparatus according to claim 27, wherein said heating means includes at least one steam-blowing box.

33. The apparatus according to claim 27, wherein said heating means is arranged above the web.

34. The apparatus according to claim 27, wherein said at least one dewatering device is a suction site.

35. The apparatus according to claim 27, wherein said heating means is positioned within said second dewatering zone.

36. The apparatus according to claim 34, wherein said suction site is provided underneath the web.

37. The apparatus according to claim 27, wherein said dewatering device includes a further heating means.

38. The apparatus according to claim 37, wherein said further heating means is a steam-blowing box.

39. The apparatus according to claim 34, wherein said heating means and suction sites are disposed opposite one another and to form a pair.

40. The apparatus according to claim 27, wherein said heating means is positioned in the open area.

41. The apparatus according to claim 34, wherein said at least one suction site is disposed in the open area.

42. The apparatus according to claim 34, wherein said heating means and said suction sites are disposed in the open area and between double screen belt presses.

43. The apparatus according to claim 27, wherein a gap between said heating means and said dewatering means is provided, said gap being adapted for the passage therethrough of the web and said apparatus further comprising gap adjustment means.

44. The apparatus according to claim 43, wherein said dewatering device is a heating means.

45. The apparatus according to claim 43, wherein said dewatering device is a suction site.

46. The apparatus according to claim 43, wherein said gap adjustment means includes means for adjusting the position of said suction site.

47. The apparatus according to claim 44, wherein said gap adjusting means includes means for adjusting the position of said heating means.

48. The apparatus according to claim 46, wherein said suction site is pivotal about an axis.

49. The apparatus according to claim 47, wherein said heating means is pivotal about an axis.

* * * * *